US007703487B2

(12) United States Patent
Garcia et al.

(10) Patent No.: US 7,703,487 B2
(45) Date of Patent: Apr. 27, 2010

(54) CUTTERHEAD

(75) Inventors: Jaime Garcia, Jackson, TN (US); Jeffrey Weston, Jackson, TN (US)

(73) Assignee: Black & Decker Inc., Newark, DE (US)

( * ) Notice: Subject to any disclaimer, the term of this patent is extended or adjusted under 35 U.S.C. 154(b) by 413 days.

(21) Appl. No.: 11/522,769

(22) Filed: Sep. 18, 2006

(65) Prior Publication Data

US 2008/0066829 A1 Mar. 20, 2008

(51) Int. Cl.
*B27C 1/00* (2006.01)

(52) U.S. Cl. ..... 144/117.1; 144/218; 144/220; 144/230; 407/40; 407/47

(58) Field of Classification Search ..... 144/114.1, 144/117.1, 172, 218, 221, 230; 83/698.41, 83/698.42, 698.51; 241/92, 93, 294; 407/40, 407/47, 48, 107
See application file for complete search history.

(56) References Cited

U.S. PATENT DOCUMENTS 988,227 A * 3/1911 Thomas ..... 144/230
1,620,847 A * 3/1927 Whisler ..... 144/230
4,658,875 A * 4/1987 Grabovac ..... 144/230
5,044,570 A * 9/1991 Montgomery, Sr. ..... 241/294

* cited by examiner

*Primary Examiner*—Shelley Self
(74) *Attorney, Agent, or Firm*—Rhonda L. Barton; Adan Ayala

(57) ABSTRACT

A cutterhead for use with a power tool includes a generally cylindrical body with a knife recess extending generally parallel to an axis of the body. The knife recess has a wall at an acute angle to a tangent of the outer surface. Received in the knife recess are a knife and a bar that includes an angled side configured to sandwich the knife between the angled wall of the recess and the angled side of the bar. A pin extends from the bar and is received in an aperture of the knife to align the knife relative to the bar. A threaded height adjustment screw is received in a threaded bore in the bar to adjust a height of the knife with respect to the body. A securing screw is received in a threaded opening in the body to secure the bar and the knife to the body.

20 Claims, 3 Drawing Sheets

CUTTERHEAD

CROSS REFERENCE TO RELATED APPLICATIONS

This application is a substitute application, under M.P.E.P. §201.09, of U.S. application Ser. No. 10/803,555, titled "Cutterhead Assembly," filed Mar. 17, 2004, now abandoned, which claims priority under 35 U.S.C. §119(e) to U.S. Provisional Patent Application Ser. No. 60/455,403, titled "Cutterhead Assembly," filed Mar. 17, 2003. Each of the foregoing applications is hereby incorporated by reference in its entirety.

TECHNICAL FIELD

This application relates to the field of woodworking and particularly to a cutterhead for power tools, for example jointers, molders, planers, and shapers.

BACKGROUND

A power tool may use one or more cutterheads to remove material from a workpiece. In certain implementations, a cutterhead has one or more knives that are mounted about a generally cylindrical member, which is rotated by the power tool to remove the material from a workpiece. The knives may be removable and/or replaceable from the cutterhead. Typical cutterheads have relatively complex mechanisms for replacing knives. For example, in some cutterheads, if one knife is damaged the user may be forced to remove an additional knife to repair or replaced the damaged knife. Blade replacement in typical cutterheads may be time intensive and may require a high level of user sophistication, knowledge, and dexterity.

In one particular implementation, one or more cutterheads may be used with a stationary jointer. For example, multiple cutterheads may be mounted between a first table at a first height and a second table at a second height. This off-set with corresponding material removal allows a user to "true-up" a workpiece or create an edge which is flat (typically the trued side is additionally squared to a second adjacent side to form a uniform shape for subsequent operations).

In another implementation, one or more cutterheads may be used with a hand held planer. Such a planer is used by woodworkers who move between worksites or utilize the shaping capability in new ways (such as for on-site timber framing). For example, hardwood lumber is typically retailed in an imperfect state. In this situation, the end consumer removes imperfections such as bows in the workpiece, imperfections from sawing operations such as from a rip cut, or rough edges before proceeding. When utilizing, e.g., salvaged materials (e.g., barn boards) metal within the workpiece such as nails, may damage the jointer's knives. As a result, a user may be left with a knife (or knives) which systematically leave a ridge longitudinally down the workpiece. To correct this problem a user may replace the knife (or knives) or sand out this imperfection.

SUMMARY

In an aspect, a knife assembly is received in a knife recess of a cutterhead. The cutterhead has a generally cylindrical body and the knife recess extends generally parallel to an axis of the cylindrical body. The knife assembly includes a knife, a bar, and a pin. The knife is configured to be received in the knife recess generally parallel to the axis. The knife defines an aperture therein. The bar is configured to be received in the knife recess adjacent the knife. The pin is coupleable to the bar and receivable in the knife aperture to align the knife relative to the bar.

Implementations of this aspect may include one or more of the following features. The knife may define a second aperture therein. A second pin may be couplable to the bar and receivable in the second knife aperture to align the knife relative to the bar. The knife aperture may extend completely through the knife. The knife aperture may be configured to allow the knife position, relative to the bar, to be adjusted parallel to the axis. The bar may include an opening that receives the pin. A securing member may be receivable in the body to secure the bar and the knife in the recess. The securing member may include a locking screw. The securing member may extend at least partially into the lock bar. A height adjustment mechanism may be configured to adjust a height of the bar and the knife relative to the recess. The height adjustment mechanism may include a threaded bore in the bar and a threaded set screw received in the bore. The bar may include a first side wall and a second side wall, the second side wall positioned at an acute angle to a line extending parallel to the first side wall. The second side wall is configured to hold the knife in the recess at an acute angle to a line extending parallel to the first side wall. The knife assembly and knife recess are configured to hold the knife at an acute angle (e.g., between approximately 10° and approximately 15°) between the angled side wall. The bar has an angled side wall (e.g., between approximately 25° and approximately 35°) configured to hold the knife at an acute cutting angle to a diameter of the body that passes through a tip of the knife and a geometric center of the body.

In another aspect, a knife assembly is for receipt in a knife recess of a cutterhead. The cutterhead has a generally cylindrical body and the knife recess extending generally parallel to an axis of the cylindrical body. The knife assembly includes a knife configured to be received in the knife recess generally parallel to the axis. A bar is configured to be received in the knife recess adjacent the knife. A securing member is configured to secure the bar and the knife in the recess. A height adjustment mechanism that is configured to adjust a height of the bar and the knife relative to the recess.

Implementations of this aspect may include one or more of the following features. The securing member includes a locking screw. The locking screw is received through an aperture in the cylindrical body. The locking screw extends at least partially into an opening in the bar. The height adjustment mechanism comprises a threaded bore in the bar and a threaded set screw received in the bore. The securing member allows the knife to be removed from the knife assembly and replaced without changing the height adjustment of the knife assembly.

In another aspect, a cutterhead for use with a power tool includes a generally cylindrical body portion having a cylindrical outer surface. The body portion defines a knife recess extending generally parallel to an axis of the body portion and a threaded opening in communication with the knife recess. The knife recess has an angled wall that is at an acute angle relative to a tangent line that is tangent to the outer surface at or near the knife recess. A knife has at least one blade and defines an aperture. A bar is configured to be received in the knife recess. The bar includes a threaded bore and an angled side configured to sandwich the knife between the angled wall of the recess and the angled side of the lock bar. A pin extends from the bar and received in the aperture for aligning the knife relative to the bar. A threaded height adjustment screw is received in the threaded bore in the bar to adjust a height of the bar with respect to the outer surface of the body portion. A securing screw is received in the threaded opening in the body portion to secure the bar and the knife to the main body.

In another aspect, a cutterhead for use with a power tool includes a cylindrical body portion having a cylindrical outer surface. The body portion defines a plurality of knife recesses extending generally parallel to an axis of the body portion and a plurality of threaded openings in communication with each of the knife recesses. Each of the knife recesses has an angled wall that is at an acute angle relative to a tangent line that is tangent to the outer surface at or near that knife recess. Received in each knife recess is a knifes having at least one blade and defining a plurality of apertures, and a bar. Each bars includes a plurality of threaded bores and an angled side configured to sandwich one of the knives between the angled wall of one of the recesses and the angled side of one of the lock bars. A plurality of pins extends from each bar and is received in the plurality of apertures in each knife for aligning that knife relative to that bar. A plurality of threaded height adjustment screws are received in the plurality of threaded bores in each of the bars to adjust a height of that bar with respect to the outer surface of the body portion. A plurality of securing screws are each received in one of the plurality of threaded openings in the body portion to secure one of the bars and one of the knives to the main body.

Advantages may include one or more of the following. The cutterhead 100 allows for rapid knife blade replacement and easy knife alignment. For example, a cutterhead in accordance with the present invention permits a user to replace a single knife blade without requiring readjustment of an adjacent knife blade. Further, the cutterhead of the present invention permits knife height adjustment from above a lock bar (radially outward from the lock bar), such as when the cutter head is implemented in a stationary joiner, or when a portable joiner is inverted for knife changing or repositioning.

These and other advantages and features will be apparent from the description, the drawings, and the claims.

DETAILED DESCRIPTION OF THE DRAWINGS

Figure 1:
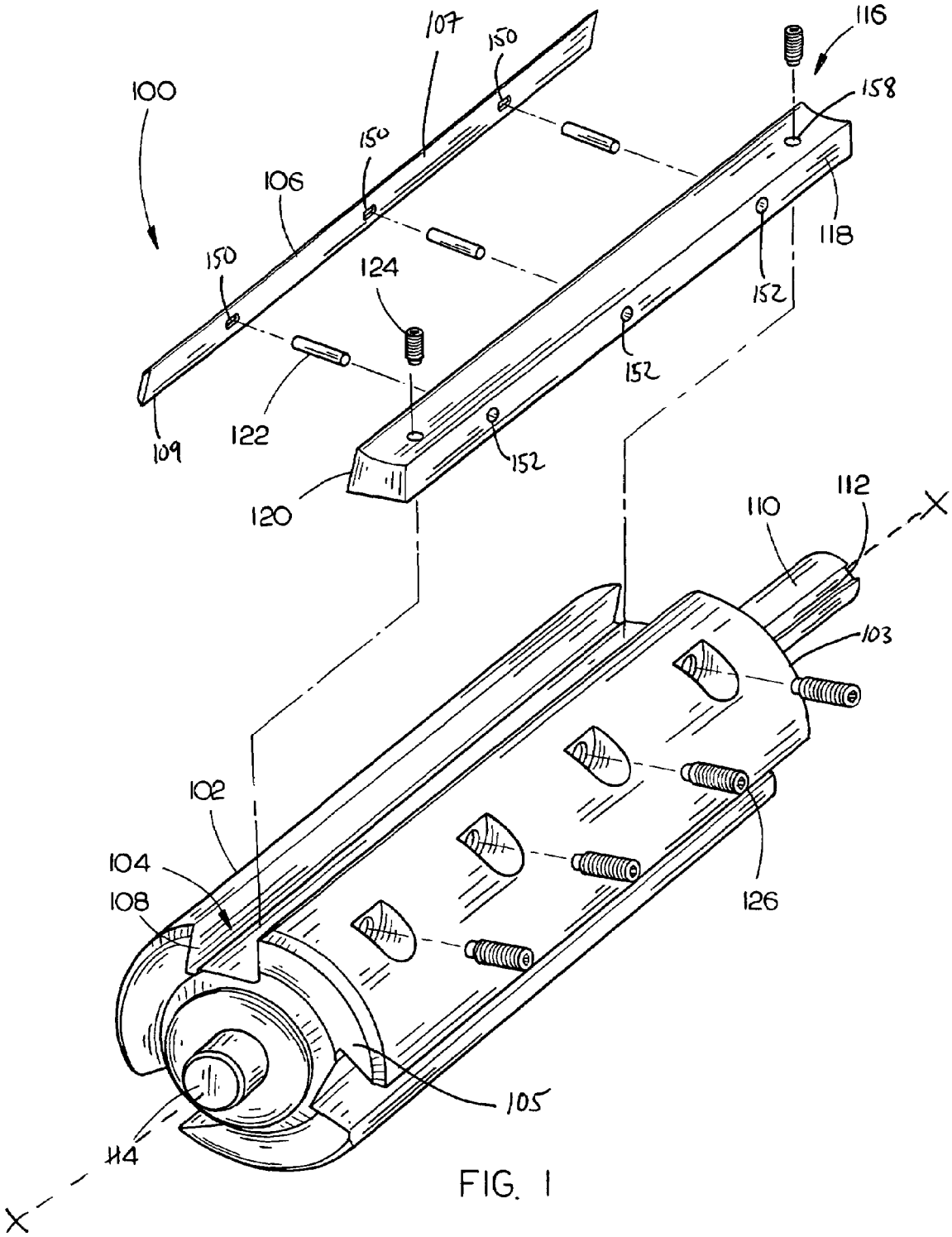
FIG. 1 is an exploded view of an implementation of a cutterhead including an adjustable knife.

Referring to FIGS. 1-4, in an implementation, a cutterhead 100 may be used in a power tool, such as a stationary jointer, a planer, a portable hand planer, a shaper (such as for forming molding), and the like. For example, the cutterhead 100 may be constructed for utilization in a 6" (six inch) jointer or an 8" (eight inch) jointer or even wider sizes, like 12", 16" or 20". Additionally, the cutterhead 100 may allow for retrofitting into existing jointers, planers, molders, shapers and the like. For instance, a drive gear, a chain sprocket, and/or a belt pulley may be included on or mounted to the cutterhead 100 for rotating the cutterhead 100.

The cutterhead 100 includes a generally cylindrical main body portion 102 that defines one or more knife recesses 104 that extend longitudinally along the main body portion 102 between a first end 103 and a second end 105 of a main body portion 102. Each knife recess 104 is configured to receive a knife assembly 116 that includes a including a lockbar 118 and a knife 106. When multiple knife assemblies 116 are utilized, the knife recesses 104 are positioned in order to balance the cutterhead 100. For example, if three knife assemblies 116 are used, as shown in FIG. 1, the knife recesses 104 are spaced from one another at approximately 120° (one hundred twenty degrees), which helps minimize vibration and provide a smooth finish to the work surface.

Figure 2:
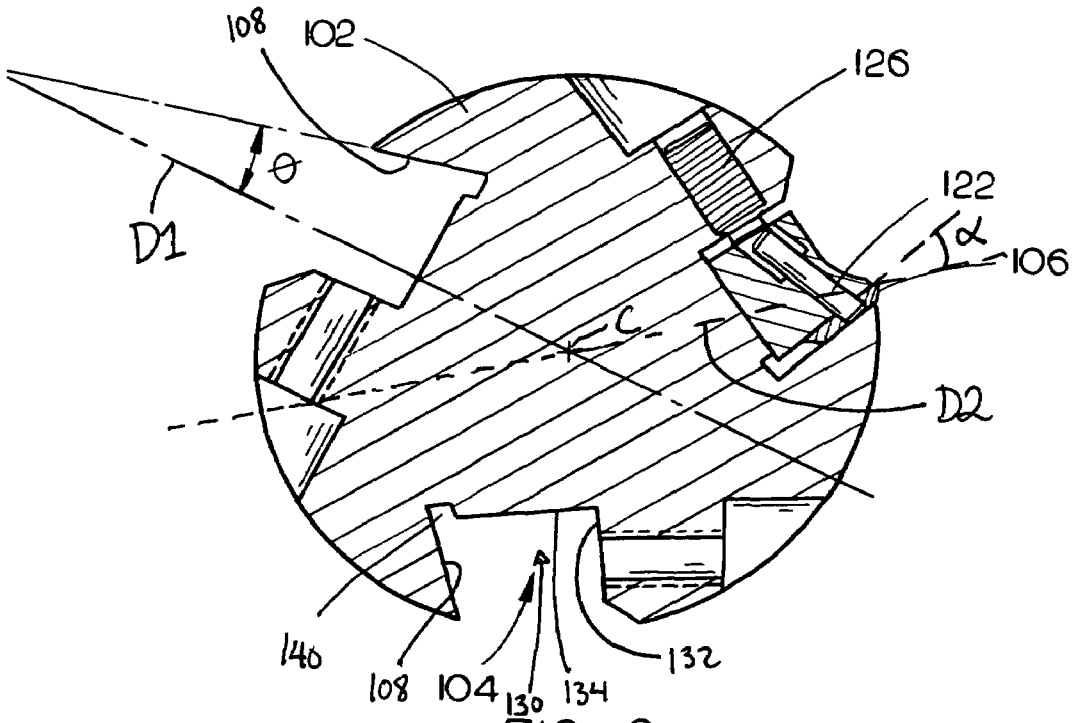
FIG. 2 is a cross-sectional view of the cutterhead of FIG. 1 taken along line 2-2 of FIG. 4.
Figure 3:
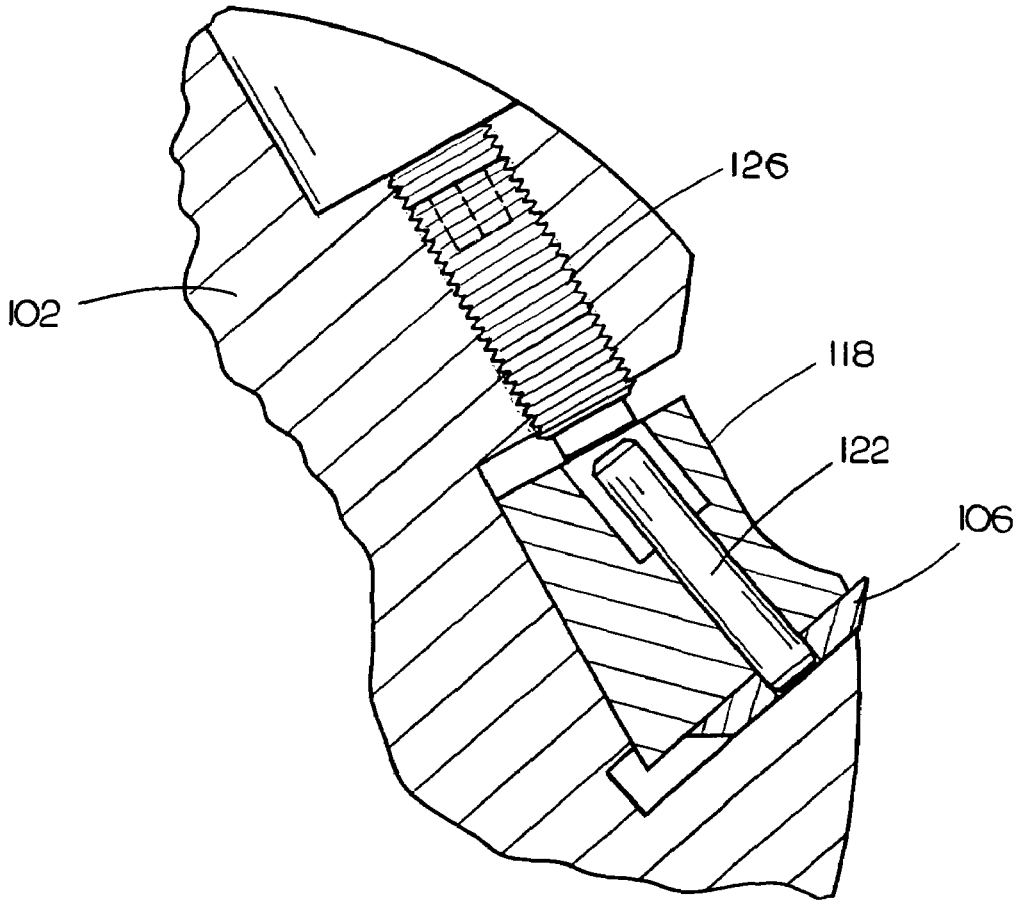
FIG. 3 is an enlarged view of FIG. 2.

Referring in particular to FIGS. 2 and 3, each knife recess 104 has a main portion 130 and a secondary portion 140. Secondary recess 140 is formed as a notch in a floor 134 of main portion 130. Main portion 130 has a generally trapezoidal cross-section defined by the floor 134, a first side wall 132 that is substantially perpendicular to floor 134, and a second, angled side wall 108. Side wall 108 is at an acute angle relative to floor 134 such that the width W1 of the recess 104 at the floor 134 is greater than the width W2 of the recess 104 at the opening of the recess 104. As described below, this angled side wall 108 facilitates holding a received knife assembly 118 and knife 106 at a desired orientation for material removal.

Referring to FIGS. 1-3, lock bar 118 of knife assembly 116 secures the removable knife 106 in the knife recess 104 by sandwiching the knife 106 against the angled sidewall 108 of the recess 104. Lock bar 118 has a substantially trapezoidal cross-section that corresponds generally to the cross-sectional shape of recess 104. Lock bar 118 includes a side 120 that is angled to correspond to the angled sidewall 108 of the knife recess. Thus, the knife 106 may be sandwiched or secured between the angled sidewall 108 of the knife recess and the angled side 120 of the lock bar. The angled side 108 of the knife recess 104 is directed so that rotation of the cutterhead forces the knife against the angled portion of the recess when the cutterhead 100 is rotated, e.g., via centripetal force, to provide an additional mechanism for holding the knife 106 firmly in place. The lock bar 118 and knife recess 104 also are dimensioned so that a user may remove the knife 106 and/or lock bar 118 from the recess 104 without having to pull the lock bar 118 out in the direction of the primary axis X. Thus, when implemented with a stationary jointer the lock bar may be efficiently removed from above the cutterhead (though a slot included between off-set support surfaces).

Referring to FIG. 2, the knife 106 is secured in the cutterhead 100 so that the knife is set at an acute positioning angle $\Theta$ between the surface 108 and a diameter D1 of body 102 that is parallel with the surface 132 and passes through the geometric center C of the cross-section of body 102. The knife 106 also is set at an acute cutting angle $\alpha$ relative to a diameter D2 of body 102 that extends through the tip of knife 106 and that passes through the geometric center C of the cross-section of body 102. The positioning angle $\Theta$ may be, for example, between approximately 10° and approximately 15°, so that centripetal forces help hold the knife 106 in place in recess 104. The cutting angle $\alpha$ may be chosen, e.g., based on the type of material of the workpiece, such as hardwood (e.g., oak, maple, walnut) or soft wood (e.g., pine), or may have an intermediate value to allow the user to implement the device for the widest range of materials. In certain implementations, the cutting angle $\alpha$ may be between approximately 25° and approximately 35°, for example, between approximately 27° and approximately 34°.

Referring to FIGS. 1 and 3, knife 106 and lock bar 118 define a series of apertures 150 and 152 (e.g., three apertures each), respectively, each of which are dimensioned to receive an index pin 122 to align the knife 106 with respect to the lock bar 118. Index pin 122 interconnects the knife 106 and lock bar 118 such that height adjustment of the lock bar 118 raises and lowers the knife 106 with respect to the outer cylindrical surface of the main body portion 102. In addition, index pins 122 may aid in maintaining proper alignment as centripetal force acts on the knife when the cutterhead is rotated. The knife apertures 150 are elongated (e.g., oval, a through channel, a key hole shaped, or the like) such that the position of the knife 106 along axis X may be adjusted. In an alternative embodiment, the lock bar apertures 152 may instead be elongated. If a knife is nicked, e.g., by a nail or other hard object, the knife may be adjusted along axis X so that corresponding nicks in other knives may be misaligned to allow for longer cutting life. In one implementation, the apertures 150 in knife 106 allow approximately a one-eighth of an inch offset, which may be sufficient for most typically encountered nicks.

The knife 106 and lock bar 118 are secured in place relative to the main body 102 by one or more securing screws 126, each of which pass through a threaded aperture 154 in main body 102 and aligned with index pin 122. Securing screws 126 engage the pin 122 in the lock bar 118, thus securing the knife 106 and lock bar 118 to the main body 102. In the present example, the securing screws drive the lock bar against the angled sidewall 108 of the recess 104. This securing system provides an additional mechanism to the angled side 108 for holding the knife assembly 116 in place, and also allows for height adjustment, as discussed below.

Figure 4:
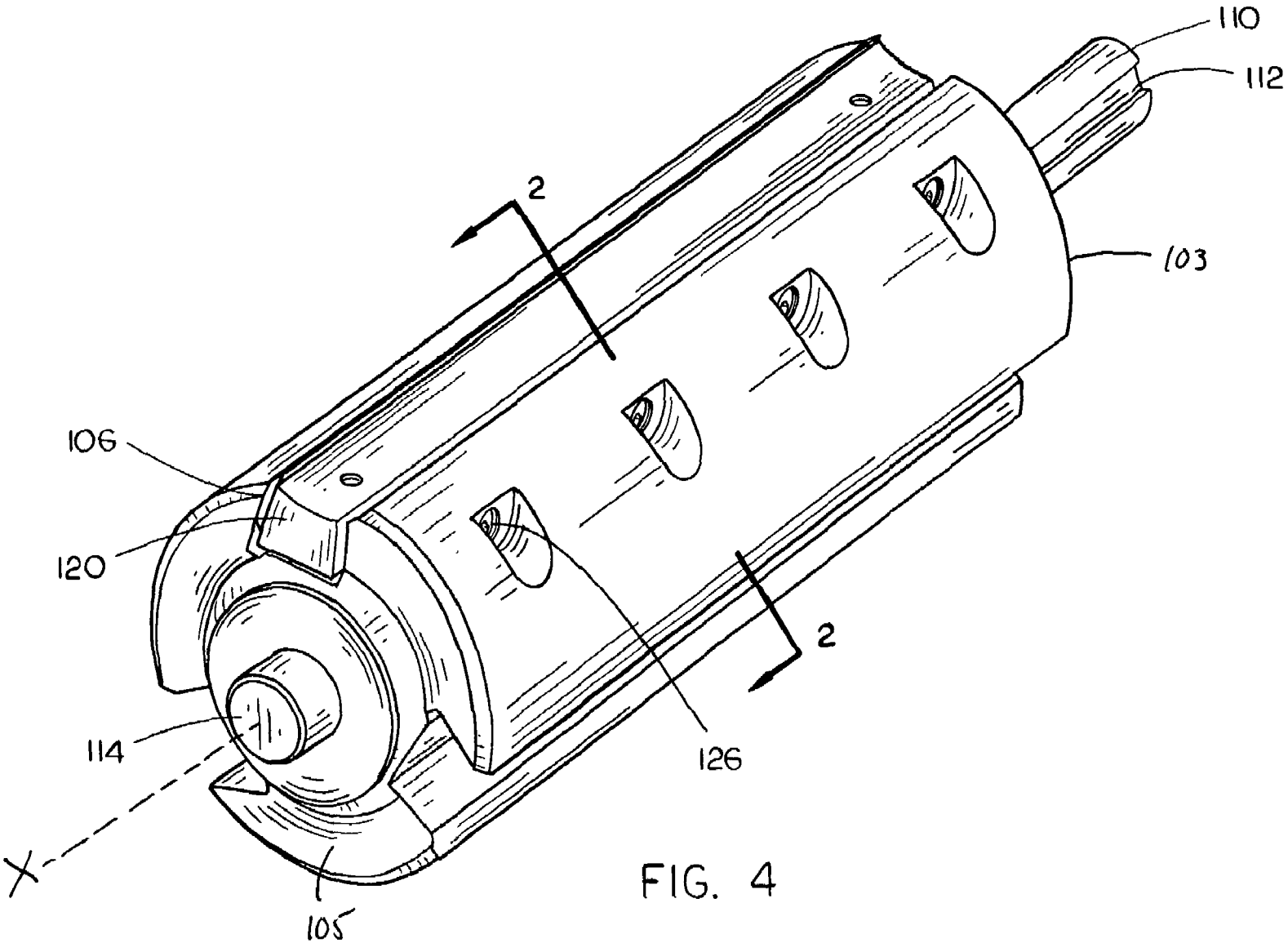
FIG. 4 is a perspective view of the cutterhead of FIG. 1.

Referring to FIGS. 1 and 4, the knife assembly 116 includes one or more height adjustment members, e.g., set screws 124 received in threaded holes 158 in lock bar 118. Set screws 124 are used to adjust the height of the lock bar 118 and knife 106 relative to the main body 102. In one implementation, two height adjustment screws 124 are utilized in order to adjust the height evenly along the lock bar 118 and knife 106. By utilizing a height adjustment screw which is threaded through the lock bar 118 a user does not have to re-adjust the height every time a knife is changed. For example, a user may remove the knife by loosening securing screws 126 without having to remove or adjust the height adjustment screws 122. When a new knife is re-inserted, the new knife will register with pins 122 and will not need to be recalibrated in height with adjacent knives.

Referring to FIG. 1, the knife 106 includes an upper blade 107 and a lower blade 109 that allows the knife 106 to be inverted should one of the blades become unusable, e.g., due to damage. The knife 106 may be disposable to avoid the need for sharpening. In alternative embodiments, the knife may have a single blade and/or the blade(s) of the knife may be able to be sharpened.

Referring to FIGS. 1 and 4, extending from first end 103 of main body 104, along primary axis X of the cutterhead 100, is a primary shaft 110. In an implementation, the primary shaft 110 includes an alignment portion, e.g., in the form of a keyway 112 for securing the cutterhead to a drive mechanism, e.g., the power tool's drive mechanism such as a pocket for receiving the primary axis 110 in a stationary joiner. Extending from second end 105 of main body 104, along primary axis X, is a secondary shaft 114, for maintaining alignment of the cutterhead and minimizing vibration during use. For example, the secondary shaft 114 is received in a pocket or recess of the power tool.

Numerous modifications may be made to the exemplary implementations described above. For example, the cutterhead may have different numbers and orientations of recesses, lock bars, knives, blades, set screws, adjusting screws, locking pins, and apertures. The knife blade may have a single cutting edge and may be constructed to be re-sharpened. The apertures in the knife blade may extend completely or only partially through the knife blade. The alignment portion of the primary shaft may be flattened portion, an alignment aperture, or another type of a mechanical interlock. The index pin may be unitary with the lock bar or secured to the lock bar (e.g. threaded into engagement with the lock bar), e.g., to prevent loss. At least a portion of the securing screw may be received in an aperture or recess included in the lock bar. Various other types of securing mechanisms may be utilized. Additional types and numbers of height adjustment mechanisms may be used. These and other implementations are within the scope of the following claims.

What is claimed is:

1. A knife assembly for receipt in a knife recess of a cutterhead, the cutterhead having a generally cylindrical body and the knife recess extending generally parallel to an axis of the cylindrical body, the knife assembly comprising:

a knife configured to be received in the knife recess generally parallel to the axis, the knife defining an aperture therein, the aperture configured to allow the knife position, to be adjusted parallel to the axis;

a bar configured to be received in the knife recess adjacent the knife, the knife position being adjustable relative to the bar;

a pin coupleable to the bar and receivable in the knife aperture to align the knife relative to the bar; and a height adjustment mechanism that is configured to adjust a height of the bar and the knife relative to the recess, wherein the height adjustment mechanism comprises a threaded bore in the bar and a threaded set screw received in the bore.

2. The knife assembly of claim 1 wherein the knife defines a second aperture therein and further comprising a second pin couplable to the bar and receivable in the second knife aperture to align the knife relative to the bar.

3. The knife assembly of claim 1 wherein the knife aperture extends completely through the knife.

4. The knife assembly of claim 1 wherein the knife aperture is configured to allow the knife position, relative to the bar, to be adjusted parallel to the axis.

5. The knife assembly of claim 1 wherein the bar comprises an opening that receives the pin.

6. The knife assembly of claim 1 further comprising a securing member receivable in the body to secure the bar and the knife in the recess.

7. The knife assembly of claim 6 wherein the securing member comprises a locking screw.

8. The knife assembly of claim 6, wherein the securing member extends at least partially into the bar.

9. The knife assembly of claim 1, wherein the bar comprises a first side wall and a second side wall, the second side wall positioned at an acute angle to a line extending parallel to the first side wall.

10. The knife assembly of claim 9, wherein the second side wall is configured to hold the knife in the recess at an acute angle to a line extending parallel to the first side wall.

11. The knife assembly of claim 9, wherein the acute angle is between approximately 10° and approximately 15°.

12. The knife assembly of claim 1, wherein the bar has an angled side wall configured to hold the knife at an acute cutting angle to a diameter of the body that passes through a tip of the knife and a geometric center of the body.

13. The knife assembly of claim 12, wherein the cutting angle is between approximately 25° and approximately 35°.

14. A knife assembly for receipt in a knife recess of a cutterhead, the cutterhead having a generally cylindrical body and the knife recess extending generally parallel to an axis of the cylindrical body, the knife assembly comprising:

a knife configured to be received in the knife recess generally parallel to the axis;

a bar configured to be received in the knife recess adjacent the knife;

a securing member configured to secure the bar and the knife in the recess; and a height adjustment mechanism that is configured to adjust a height of the bar and the knife relative to the recess, wherein the height adjustment mechanism comprises a threaded bore in the bar and a threaded set screw received in the bore.

15. The knife assembly of claim 14, wherein the securing member comprises a locking screw.

16. The knife assembly of claim 15, wherein the locking screw is received through an aperture in the cylindrical body.

17. The knife assembly of claim 16, wherein the locking screw extends at least partially into an opening in the bar.

18. The knife assembly of claim 14, wherein the securing member allows the knife to be removed from the knife assembly and replaced without changing the height adjustment of the knife assembly.

19. A cutterhead for use with a power tool, comprising:

a cylindrical body portion having a cylindrical outer surface, the body portion defining a knife recess extending generally parallel to an axis of the body portion and a threaded opening in communication with the knife recess, the knife recess having an angled wall that is at an acute angle relative to a tangent line that is tangent to the outer surface at or near the knife recess;

a knife having at least one blade and defining an aperture;

a bar configured to be received in the knife recess, the bar including a threaded bore and an angled side configured to sandwich the knife between the angled wall of the recess and the angled side of the lock bar;

a pin extending from the bar and received in the aperture for aligning the knife relative to the bar;

a threaded height adjustment screw received in the threaded bore in the bar to adjust a height of the bar with respect to the outer surface of the body portion; and a securing screw received in the threaded opening in the body portion to secure the bar and the knife to the main body.

20. A cutterhead for use with a power tool, comprising:

a cylindrical body portion having a cylindrical outer surface, the body portion defining a plurality of knife recesses extending generally parallel to an axis of the body portion and a plurality of threaded openings in communication with each of the knife recesses, each of the knife recesses having an angled wall that is at an acute angle relative to a tangent line that is tangent to the outer surface at or near the knife recess;

a plurality of knives, each having at least one blade and each defining a plurality of apertures;

a plurality of bars, each configured to be received in one of the knife recesses, the bars each including a plurality of threaded bores and an angled side configured to sandwich one of the knives between the angled wall of one of the recesses and the angled side of one of the lock bars;

a plurality of pins extending from each bar and received in the plurality of apertures in each knife for aligning that knife relative to that bar;

a plurality of threaded height adjustment screws, each received in one of the plurality of threaded bores in one of the bars to adjust a height of that bar with respect to the outer surface of the body portion; and a plurality of securing screws, each received in one of the plurality of threaded openings in the body portion to secure one of the bars and one of the knives to the main body.

* * * * *